US009660330B2

(12) United States Patent
Chi et al.

(10) Patent No.: US 9,660,330 B2
(45) Date of Patent: May 23, 2017

(54) QUASI-FRACTAL ANTENNA

(71) Applicant: TAI-SAW TECHNOLOGY CO., LTD, Taoyuan (TW)

(72) Inventors: Kuang-Ting Chi, New Taipei (TW); Ken-Huang Lin, Kaohsiung (TW); Yu-Tung Huang, Taoyuan (TW); Chi-Yun Chen, Taoyuan (TW)

(73) Assignee: TAI-SAW TECHNOLOGY CO., LTD., Taoyuan (TW)

( * ) Notice: Subject to any disclaimer, the term of this patent is extended or adjusted under 35 U.S.C. 154(b) by 586 days.

(21) Appl. No.: 13/782,520

(22) Filed: Mar. 1, 2013

(65) Prior Publication Data

US 2013/0229311 A1 Sep. 5, 2013

(30) Foreign Application Priority Data

Mar. 1, 2012 (TW) ..... 101106805 A

(51) Int. Cl.
*H01Q 1/38* (2006.01)
*H01Q 1/22* (2006.01)
*H01Q 1/36* (2006.01)

(52) U.S. Cl.
CPC ..... *H01Q 1/38* (2013.01); *H01Q 1/22* (2013.01); *H01Q 1/36* (2013.01)

(58) Field of Classification Search
CPC ..... H01Q 1/38; H01Q 1/36
USPC ..... 343/700 MS
See application file for complete search history.

(56) References Cited

U.S. PATENT DOCUMENTS

2007/0013587 A1* 1/2007 Liu et al. ..... 343/702
2010/0008825 A1 1/2010 Subramanyam
2011/0036173 A1* 2/2011 Chommeloux et al. ..... 73/702
2012/0001826 A1 1/2012 Achour et al.

OTHER PUBLICATIONS

Nickolas Kingsley, et al. (2007), RF MEMS: Sequentially Reconfigurable Sierpinski Antenna on a Flexible Organic Substrate with Novel DC-Biasing Technique, Journal of Microelectromechanical Systems, vol. 16, No. 5, pp. 1185-1192.
Taiwanese Office Action dated May 6, 2015.

* cited by examiner

*Primary Examiner* — Graham Smith
(74) *Attorney, Agent, or Firm* — Tarter Krinsky & Drogin LLP

(57) ABSTRACT

The present invention provides to an antenna. The antenna includes a piezoelectric-substrate layer; and a quasi-fractal radiating layer disposed on the piezoelectric-substrate layer and having a quadrangle sub-structure and a similar structure that is formed by a nth-order self-similar iteration process including a trimming step, a scaling step and a combining step on the basis of the quadrangle sub-structure, where n is an integer greater than zero.

18 Claims, 10 Drawing Sheets

QUASI-FRACTAL ANTENNA

The application claims the benefit of Taiwan Patent Application No. 101106805, filed on Mar. 1, 2012, in the Intellectual Property Office of Republic of China, the disclosure of which is incorporated by reference as if fully set forth herein.

FIELD OF THE INVENTION

The present invention relates to a quasi-fractal antenna, particularly to the quasi-fractal antenna which is integrated with a surface acoustic wave component, a high frequency component or a passive component.

BACKGROUND OF THE INVENTION

There are two advantages for using the fractal structure in the conventional fractal antenna in the tradition. The first advantage is the characteristic of the self-similarity, a structure repeatability which has a plurality of similar replicated sub-structure, the scale of each of which sub-structure is gradually reduced, so that the same structural details in each smaller repeated sub-structure is replicated, resulting in easily producing multiple frequency effect for the application of the antenna. The second advantage is the space-filling characteristic in which the antenna can extend the current path in the limited space by the geometry of the fractal sub-structure within the limited space, resulting in achieving the lower resonant frequency band easily, and reducing the area occupied by the antenna to achieve the purpose of miniaturization.

However, using the fractal structure as the design of the antenna has several defects: (1) In order to retain the complete geometry of the fractal structure, the antenna will occupy a relatively larger area in the application of the mobile communication device; (2) For having the lowest resonant frequency band for the antenna, the load metal strip will be configured at the end of the fractal geometry structure. Although the current resonant path can be increased to achieve the low frequency effect, the load metal strip will destroy the kindness of minimizing the fractal structure antenna; (3) Using the microstrip line as the signal feed form: the signal feed of the fractal antenna and the connected ground plane thereof is non-coplanar, which renders the fractal antenna being difficult to integrate with the surface acoustic wave component, the high frequency component or the passive component of the mobile communication devices; and (4) As stated in (3), the microstrip line is usually used in the fractal antenna, and can easily lead to radiation losses, resulting in reducing the radiation efficiency, which is a major problem for applying in the low frequency band fractal antenna.

To sum up the above disadvantages, it is necessary to provide a new antenna structure for overcoming the above-mentioned defects. It is therefore attempted by the applicant to deal with the above situation encountered in the prior art.

SUMMARY OF THE INVENTION

In view of the several disadvantages in the prior arts, the present invention provides a miniaturized quasi-fractal antenna that is integrated with a surface acoustic wave (SAW) component, a high frequency component or a passive component. Such integration of the piezoelectric component antenna with the printed circuit board antenna of the surface acoustic wave component can render the antenna being chiplized to decrease the size of the antenna occupied in the mobile communication device.

In an antenna, including: a piezoelectric substrate and a radiating portion configured on the piezoelectric-substrate. The radiating portion includes a first radiating portion including a ground end and a signal feed end and a second radiating portion electrically connected with the first radiating portion and having a self-similar conformation.

In an antenna, including: a dielectric substrate layer and a quasi-fractal radiating layer configured on the dielectric substrate layer.

In an antenna, including: a coplanar wave guide layer and a quasi-fractal antenna layer configured on the coplanar wave guide layer and having a self-similar conformation.

Other objects, advantages and efficacy of the present invention will be described in detail below taken from the preferred embodiments with reference to the accompanying drawings, in which:

BRIEF DESCRIPTION OF THE DRAWINGS

FIG. 1(*b*) is a perspective view schematic diagram illustrating the quasi-fractal antenna structure according to the present invention.

FIG. 2(*b*) is a schematic diagram illustrating the second-order sub-structure of the quasi-fractal antenna according to the present invention.

FIG. 2(*c*) is a schematic diagram illustrating the third-order sub-structure of the quasi-fractal antenna according to the present invention.

FIG. 2(*d*) is a schematic diagram illustrating the fourth-order sub-structure of the quasi-fractal antenna according to the present invention.

FIG. 4(*b*) is a top view schematic diagram illustrating the quasi-fractal coplanar wave guide antenna according to the present invention.

FIG. 4(*c*) is a perspective view schematic diagram illustrating the quasi-fractal coplanar wave guide antenna according to the present invention.

FIG. 5(*b*) is a radiation pattern diagram illustrating the radiation pattern in 2.45 GHz for the quasi-fractal coplanar wave guide antenna according to the present invention.

FIG. 6(*b*) is a radiation pattern diagram illustrating the radiation pattern in 1.57 GHz for the quasi-fractal coplanar wave guide antenna according to the present invention.

DETAILED DESCRIPTION

Figure 1A:
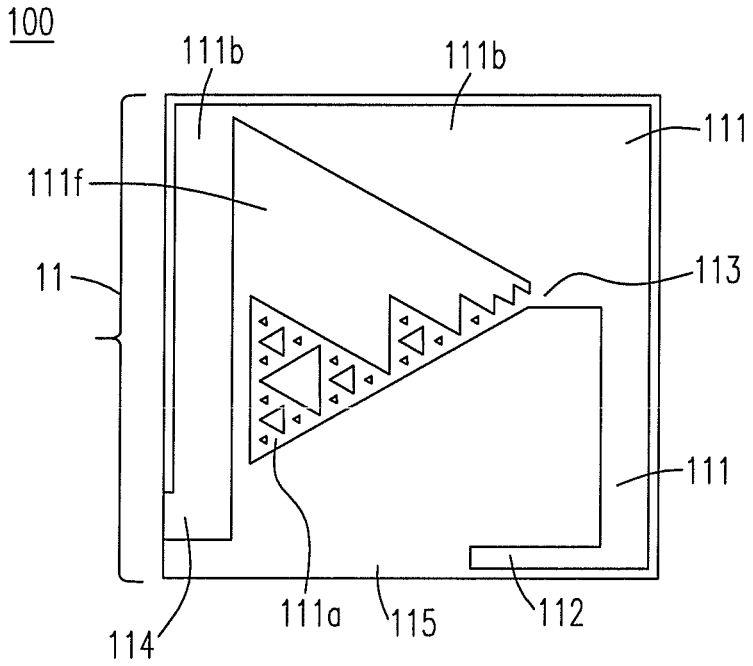
FIG. 1(*a*) is a top view schematic diagram illustrating the quasi-fractal antenna structure according to the present invention.

The present disclosure will be described with respect to particular embodiments and with reference to certain drawings, but the disclosure is not limited thereto but is only limited by the claims. The dimensions and the relative dimensions do not necessarily correspond to actual reductions to practice.

Furthermore, the terms first, second and the like in the description and in the claims, are used for distinguishing between similar elements and not necessarily for describing a sequence, either temporally, spatially, in ranking or in any other manner. It is to be understood that the terms so used are interchangeable under appropriate circumstances and that the embodiments described herein are capable of operation in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that the embodiments described herein are capable of operation in other orientations than described or illustrated herein.

It is to be noticed that the term "including", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device including means A and B" should not be limited to devices consisting only of components A and B.

Reference throughout this specification to "one embodiment" or "an embodiment" means that a particular feature, structure or characteristic described in connection with the embodiment is included in at least one embodiment. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the description of exemplary embodiments, various features are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed disclosure requires more features than are expressly recited in each claim. Rather, as the following claims reflect, inventive aspects lie in less than all features of a single foregoing disclosed embodiment. Thus, the claims following the detailed description are hereby expressly incorporated into this detailed description, with each claim standing on its own as a separate embodiment.

Furthermore, while some embodiments described herein include some but not other features included in other embodiments, combinations of features of different embodiments are meant to be within the scope of the disclosure, and form different embodiments, as would be understood by those in the art. For example, in the following claims, any of the claimed embodiments can be used in any combination.

In the description provided herein, numerous specific details are set forth. However, it is understood that embodiments may be practiced without these specific details. In other instances, well-known methods, structures and techniques have not been shown in detail in order not to obscure an understanding of this description.

The disclosure will now be described by a detailed description of several embodiments. It is clear that other embodiments can be configured according to the knowledge of persons skilled in the art without departing from the true technical teaching of the present disclosure, the claimed disclosure being limited only by the terms of the appended claims.

Figure 1B:
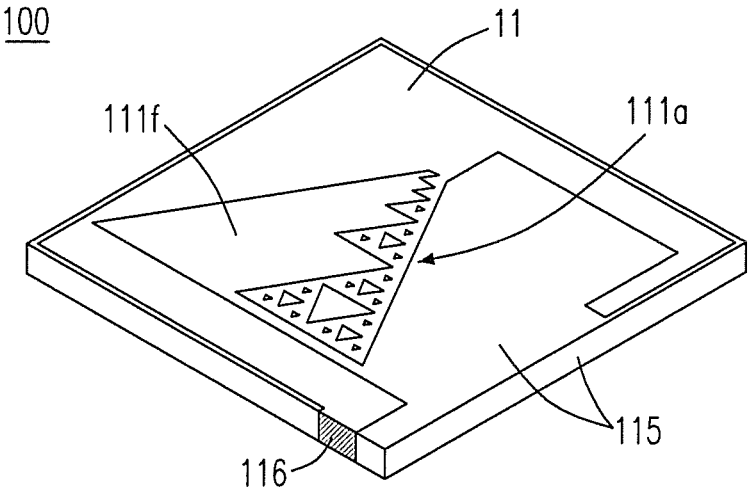
Figure 2A:
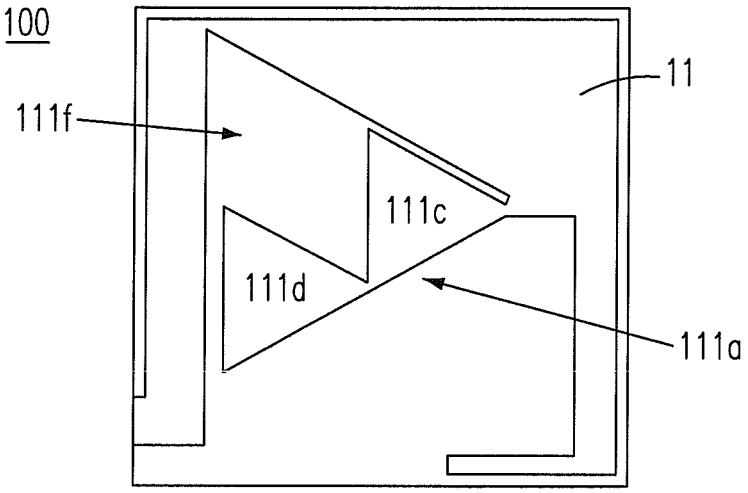
FIG. 2(*a*) is a schematic diagram illustrating the first-order sub-structure of the quasi-fractal antenna according to the present invention.
Figure 2B:
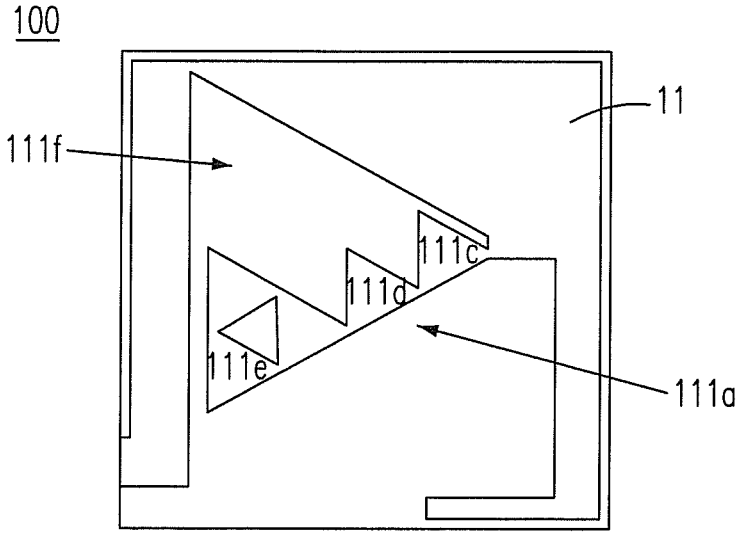
Figure 2C:
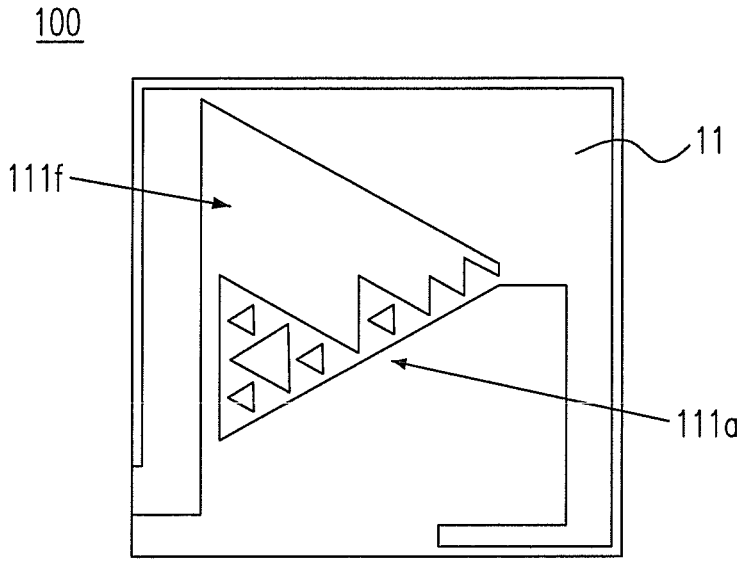
Figure 2D:
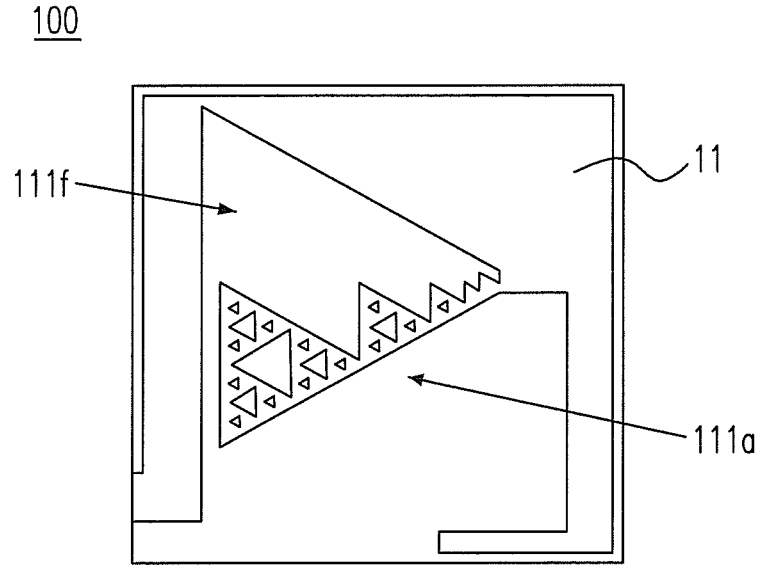

Please refer to FIGS. 1(*a*) and 1(*b*), wherein FIG. 1(*a*) is a top view schematic diagram illustrating the quasi-fractal antenna structure according to the present invention, and FIG. 1(*b*) is a perspective view schematic diagram illustrating the quasi-fractal antenna structure according to the present invention. The quasi-fractal antenna 100 is prepared by a metal strip 11 configured on a dielectric substrate 115. The dielectric substrate 115 is preferably a piezoelectric material behaving as a supporter of the metal strip 11. The quasi-fractal antenna 100 includes a radiating portion 111, a signal feed end 112 and a ground end 114 and 116, wherein the radiating portion 111 includes a quasi-fractal radiating portion 111*a*, a loop radiating portion 111*b* and a bifurcation point 113. The pattern of the loop radiating portion 111*b* of the radiating portion 111 is designed to have a hollow-out area 111*f*, the pattern of the hollow-out area is corresponding to the whole pattern of the quasi-fractal radiating portion 111*a*, and the size of the hollow-out area can generally accommodate another quasi-fractal radiating portion 111*a*.

Since the piezoelectric materials used in the surface acoustic wave component of the mobile communication device have high permittivity, the piezoelectric materials will be the best antenna substrate materials. Therefore, the piezoelectric material used in the surface acoustic wave component can be used as a dielectric substrate 115 in the present quasi-fractal antenna 100. The dielectric substrate 115 is preferably the surface acoustic wave component, for example: the piezoelectric material or piezoelectric material substrate used in a radio frequency surface acoustic wave filter, an intermediate frequency surface acoustic wave filter and a surface acoustic wave resonator. Furthermore, as the signal feed used in the present quasi-fractal antenna 100 and the connected ground plane thereof is non-coplanar, the present quasi-fractal antenna 100 can be further integrated with the high frequency component or passive component, such as filter, low noise amplifier, power amplifier, inductance, capacitance or resistance and so on, which is common in other mobile communication device.

According to the structure of the quasi-fractal antenna 100 of the present invention, it can share the same substrate with the surface acoustic wave component, the high frequency component or the passive component. That is to say, the quasi-fractal antenna 100 is manufactured at the back of the surface acoustic wave component, the high frequency component or the passive component, and to integrate the quasi-fractal antenna 100 with the surface acoustic wave component, the high frequency component or the passive component, so that the volume of the quasi-fractal antenna 100 occupied in the mobile communication device will be reduced, and the configuration space of the antenna in the mobile communication device is not necessary to be planned, thus the overall volume of the mobile communication device will be miniaturized.

Please refer to FIGS. 2(*a*) to 2(*d*), which illustrate each orders of the quasi-fractal radiating portion 111*a* according to the present invention. The quasi-fractal radiating portion 111*a* includes a sub-structure and a similar structure. The quasi-fractal radiating portion 111*a* is a conformation formed by an nth-order self-similar iteration process including a trimming step, a scaling step and a combining step based on the sub-structure, where n is an integer greater than zero.

Figure 3:
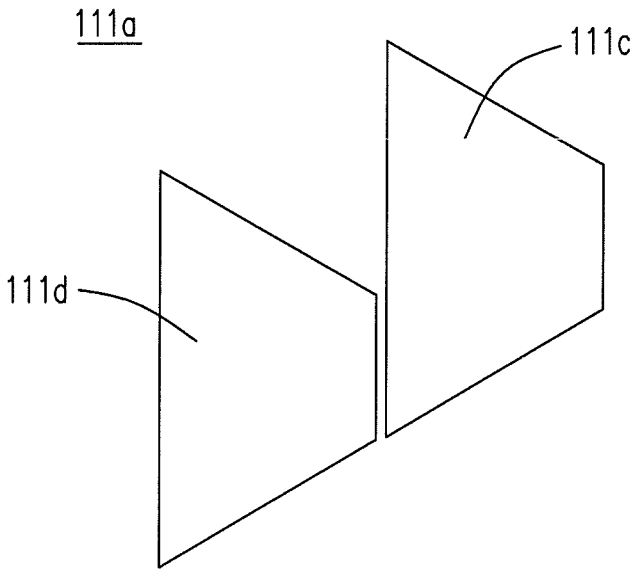
FIG. 3 is an enlarged view schematic diagram illustrating the first-order sub-structure in FIG. 2(*a*) according to the present invention.

For FIG. 2(*a*) as an example, the quasi-fractal radiating portion 111*a* includes the sub-structure 111*c* and the similar structure 111*d*. The similar structure 111*d* is a conformation formed by a first-order scaling self-similar iteration process based on the sub-structure 111*c*. It is noteworthy that the sub-structure 111*c* and the similar structure 111*d* in the FIG. 2(*a*) are preferably a quadrangular trapezoid. Please refer to FIG. 3 which is an enlarged view schematic diagram illustrating first-order the sub-structure 111*c* in FIG. 2(*a*). It can be clearly identified from FIG. 3 that the conformation of the trapezoid of the similar structure 111*d* is formed by the first-order scaling self-similar iteration process based on the trapezoid of sub-structure 111*c*.

Identically, continuing use the trapezoid of the sub-structure as an example, the quasi-fractal radiating portion 111*a* in FIG. 2(*b*) includes the sub-structure 111*c*, the first-order similar structure 111*d* and the second-order similar structure 111*e*. The first-order similar structure 111*d* and the second-order similar structure 111*e* are the conformations respective formed by the first-order and the second-order self-similar iteration process including the trimming step, the scaling step and the combining step based on the sub-structure 111*c*.

And so on, continuing to use the trapezoid of the sub-structure as an example, the quasi-fractal radiating portion 111*a* in FIG. 2(*c*) includes the sub-structure 111*c* and the third-order similar structure. The quasi-fractal radiating portion 111*a* in FIG. 2(*d*) includes the sub-structure 111*c* and the fourth-order similar structure. The pattern of the quasi-fractal radiating portion 111*a* in FIG. 2(*d*) is the quasi-fractal radiating portion 111*a* showed in FIGS. 1(*a*) and 1(*b*). The sub-structure can also be a triangular, a quadrangular, a rectangular, a square and other geometric shapes. When the pattern of the sub-structure is in the form of triangle, the pattern of a part of the quasi-fractal radiating portion 111*a* is similar with the Sierpinski Gasket quasi structure, but the quasi-fractal radiating portion 111*a* is not the Sierpinski Gasket quasi structure.

Figure 4A:
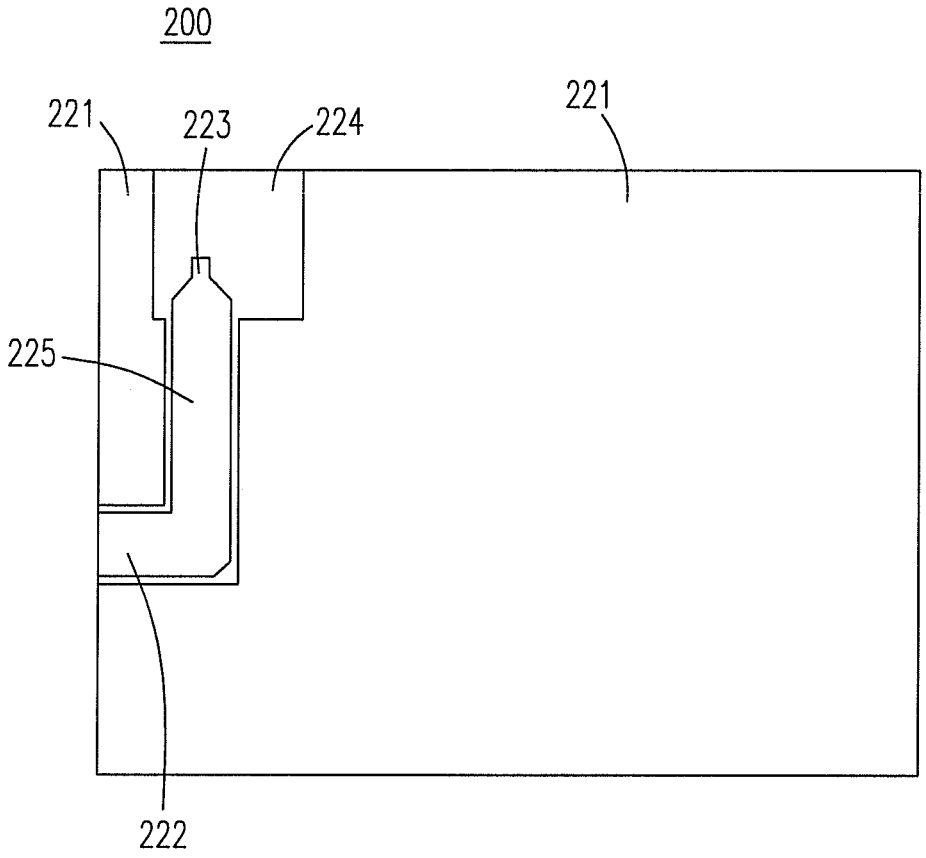
FIG. 4(*a*) is a schematic diagram illustrating the coplanar wave guide structure according to the present invention.
Figure 4B:
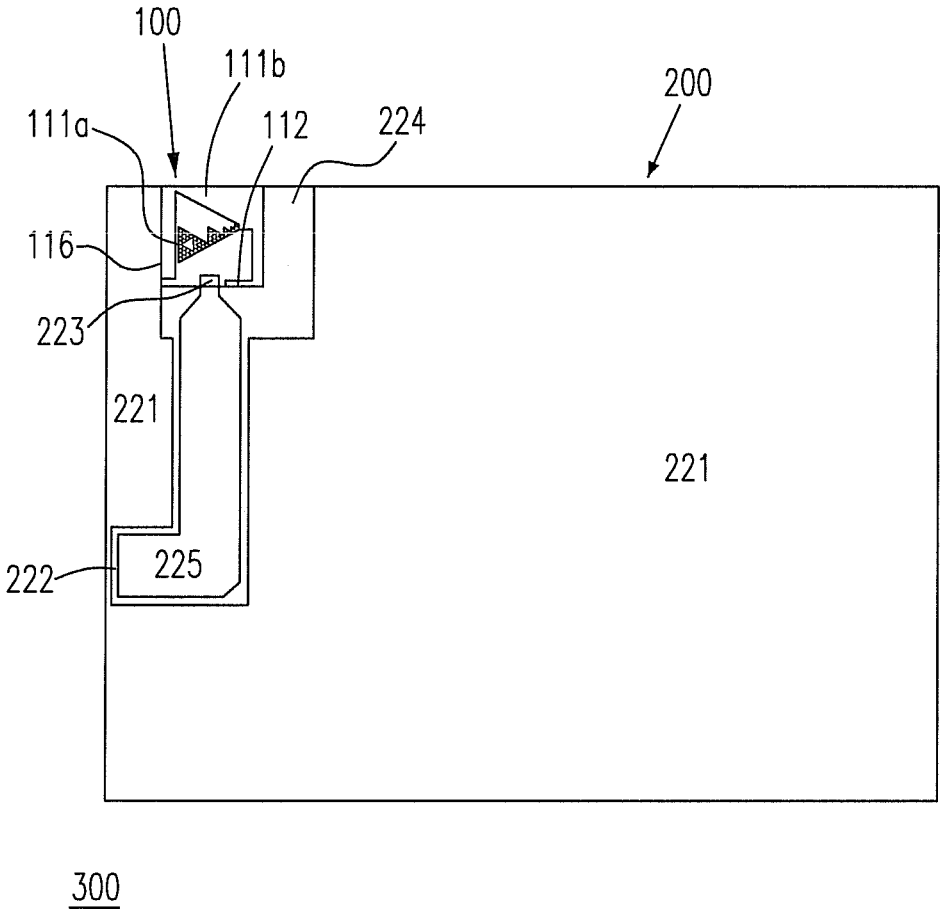
Figure 4C:
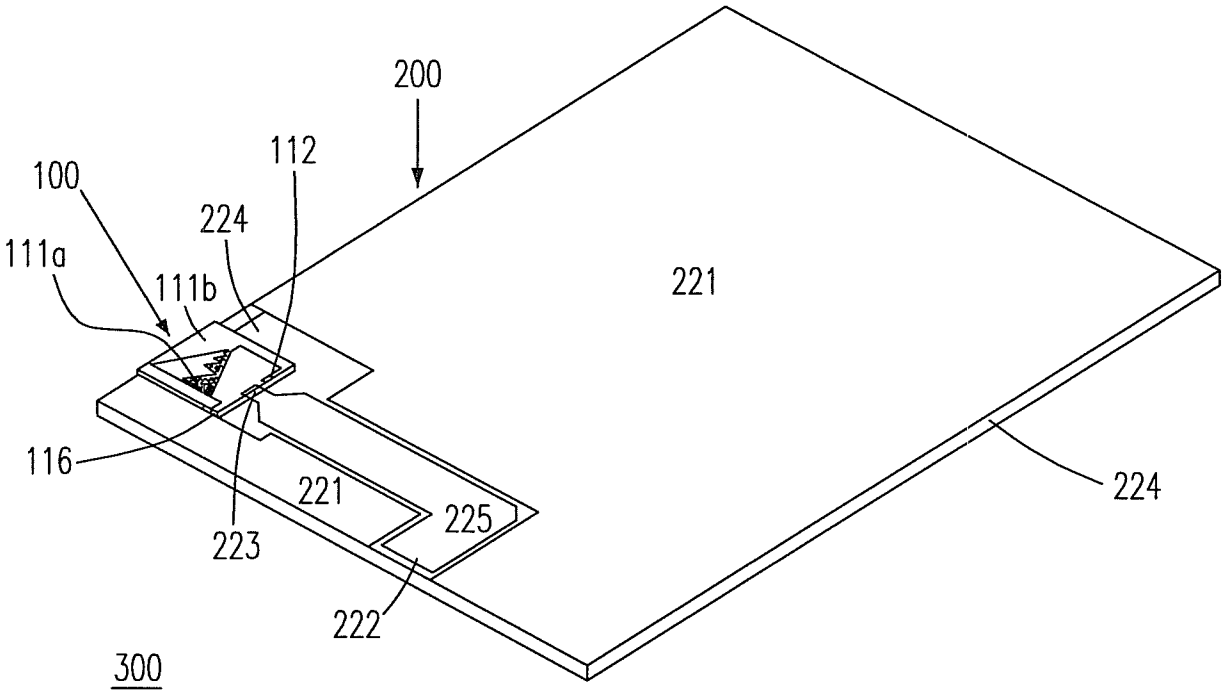

Please refer to FIGS. 4(*a*) to 4(*c*), FIG. 4(*a*) is a schematic diagram illustrating the coplanar wave guide structure according to the present invention, FIG. 4(*b*) is a top view schematic diagram of the quasi-fractal coplanar wave guide antenna of the present invention and FIG. 4(*c*) is a perspective view schematic diagram of the quasi-fractal coplanar wave guide antenna of the present invention.

The coplanar wave guide structure 200 in FIG. 4(*a*) includes a ground metal strip 221 regarded as a coplanar wave guide metal strip, a coupling feed metal strip 225 and a dielectric material 224, wherein the coupling feed metal strip 225 includes a signal transmission end 222 and a coupling feed end 223, and the dielectric material 224 is preferably a printed circuit board (PCB).

The quasi-fractal coplanar wave guide antenna 300 of FIGS. 4(*b*) and 4(*c*) includes a quasi-fractal antenna 100 having the quasi-fractal radiating portion 111*a*, the ground end 116 and signal feed end 112 aforementioned, and a coplanar wave guide structure 200 having the ground metal strip 221, the coupling feed metal strip 225, the dielectric material 224, the signal transmission end 222 and the coupling feed end 223. The quasi-fractal antenna 100 is electrically connected with the coupling feed end 223 of the coplanar wave guide structure 200 by the signal feed end 112, and the ground end 116 of the quasi-fractal antenna 100 is electrically connected with the ground metal strip 221 of the coplanar wave guide structure 200. The quasi-fractal antenna 100 is connected with the coplanar wave guide structure 200 by a flip-chip process or a non-conductive adhesive method to integrate both the quasi-fractal antenna 100 and the coplanar wave guide structure 200 to form the quasi-fractal coplanar wave guide antenna 300. Whether receiving or transmission all signals, the signal is followed by a path formed by the signal transmission end 222, the coupling feed end 223, the signal feed end 112, the loop radiating portion 111*b* and quasi-fractal radiating portion 111*a* to pass in and out of the quasi-fractal antenna 100 or the coplanar wave guide structure 200.

In summary, the quasi-fractal coplanar wave guide antenna 300 of the present invention is a dual-frequency antenna used a piezoelectric component that is common used in integration of the surface acoustic wave component. The piezoelectric component mainly uses two different layers of the dielectric substrate materials. In the coplanar wave guide structure 200, the dielectric layer uses a conventional printed circuit board as the main substrate of the antenna. The system board of the mobile communication device can directly used as the printed circuit board, the coplanar wave guide metal strip having one signal transmission end 222 and two ground metal strips 221 is printed or etched on the printed circuit board, which renders the structure and the production thereof being quite simple, and can be easily integrated with the system board of any mobile communication device. In the quasi-fractal antenna 100, the dielectric layer uses a surface acoustic wave component, such as the surface acoustic wave filter component and piezoelectric material, as the main substrate of the antenna. Since the high permittivity of the piezoelectric material, the piezoelectric material is also the best substrate material of the antenna.

Viewing from another angle, the quasi-fractal coplanar wave guide antenna 300 of the present invention includes two layers of components, respectively are the quasi-fractal antenna 100 and the coplanar wave guide structure 200. Using a coupling feed method between the layers to avoid the common wire-break situation, and using a feed method of coplanar wave guide at one of the layers to decrease the radiation loss by the feed of the microstrip line and provide an environment to render the layers being easier to be integrated with surface acoustic wave component by the flip chip process or the non-conductive adhesive method. The other layer is used as the substrate material of the antenna to render the antenna being integrated with the circuits.

The radiating portion 111 of the quasi-fractal antenna 100 aforementioned is divided into the quasi-fractal radiating portion 111*a* and the loop radiation 111*b* from the bifurcation point 113. The quasi-fractal radiating portion 111*a* essentially is a monopole antenna. The quasi-fractal radiating portion 111*a* can operate independently. The quasi-fractal radiating portion 111*a* cooperates with the dielectric substrate 115 will become a monopole antenna that can operate independently. The loop radiating portion 111*b* essentially is a loop antenna. The quasi-fractal antenna 100 of the present invention combines the quasi-fractal radiating portion 111*a* and the loop radiating portion 111*b*, and electrically connects between the two radiating portions. This renders the quasi-fractal radiating portion 111*a* being capable of producing a resonant with the loop radiating portion 111*b*, and achieves a dual-frequency resonant effect by the characteristics of the current paths of the two resonant. Hence, the quasi-fractal antenna 100 aforementioned is also a dual band antenna.

The quasi-fractal coplanar wave guide antenna 300 and the quasi-fractal antenna 100 are the antennas having the loop and monopole. By the design of loop, the thickness of the substrate material in the antennas need not too thick that will let the antenna has higher radiation efficiency. By the design of monopole, the current path will be prolonged in a limited space by a polygon fractal structure, which reduced the area occupied by the antenna of the present invention up to 75% or more comparing with the same band fractal antenna products at present.

Figure 5A:
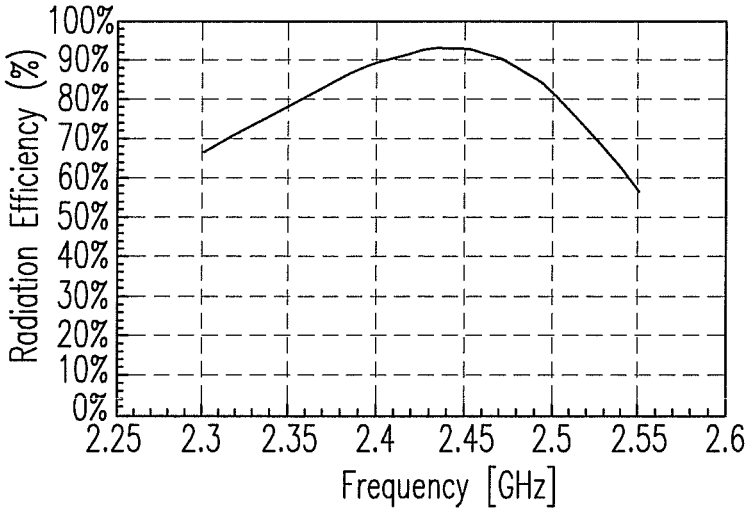
FIG. 5(*a*) is a radiation efficiency diagram illustrating the frequency band in a range of 2.3-2.55 GHz for the quasi-fractal coplanar wave guide antenna according to the present invention.
Figure 5B:
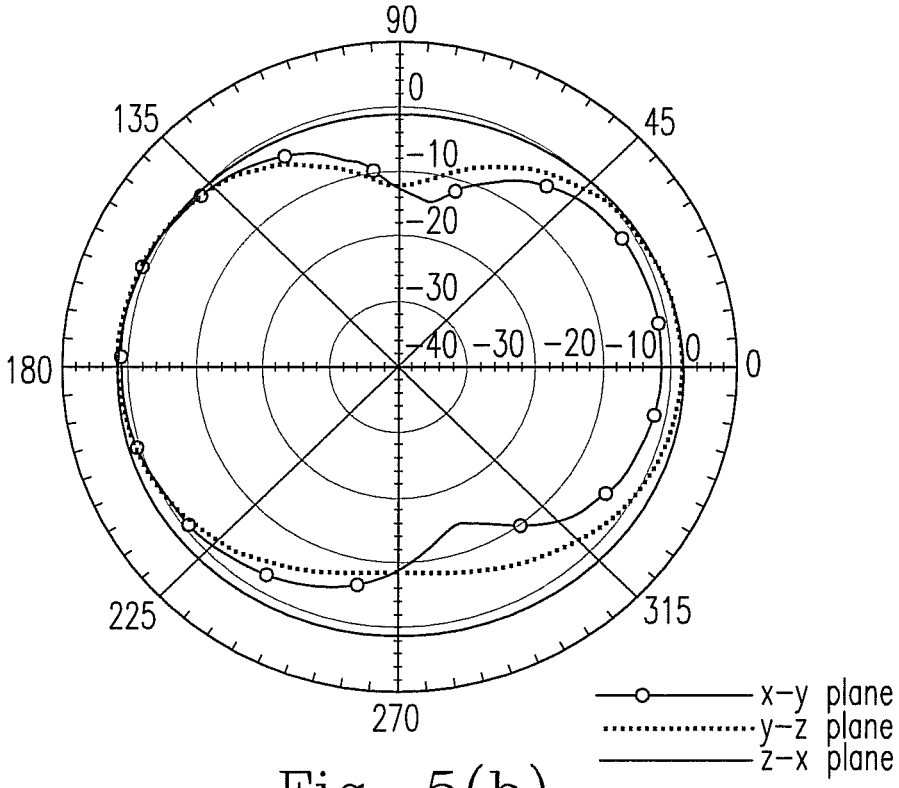
Figure 7:
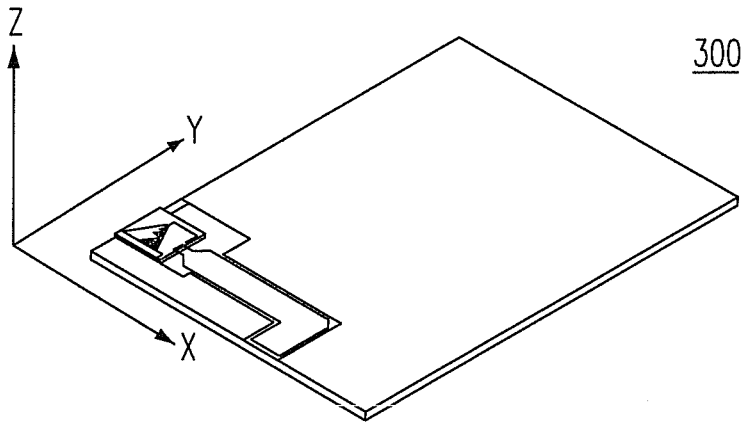
FIG. 7 is a relative position schematic diagram illustrating the quasi-fractal coplanar wave guide antenna in the cassette coordinate including an x-axis, a y-axis and a z-axis according to the present invention.
Figure 8:
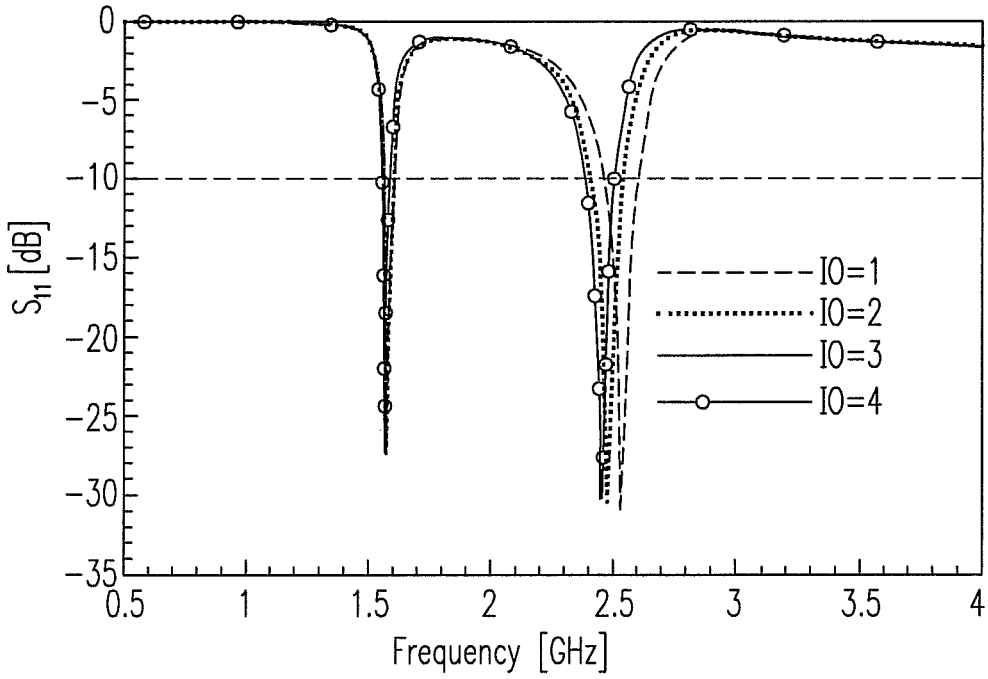
FIG. 8 is a reflection coefficient of frequency response schematic diagram illustrating the quasi-fractal coplanar wave guide antenna according to the present invention.

The quasi-fractal coplanar wave guide antenna 300 aforementioned, based on the monopole antenna of the quasi-fractal radiating portion 111*a*, the nth-order self-similar iteration process can prolong the resonant path thereof in the limited space. After the test, the antenna has good matching characteristics $S_{11} \leftarrow 10$ dB in 2.4-2.484 GHz wireless local area network (WLAN) frequency band. Please refer to FIG. 5(*a*) which is a radiation efficiency diagram illustrating the frequency band in a range of 2.3-2.55 GHz for the quasi-fractal coplanar wave guide antenna according to the present invention obtained by the simulation software. FIG. 5(*b*) is a radiation pattern diagram illustrating the frequency band in 2.45 GHz for the quasi-fractal coplanar wave guide antenna according to the present invention obtained by the simulation software. The x-y plane, y-z plane and z-x plane in FIG. 5(*b*) please refer to FIG. 7, which defining a relative position schematic diagram of the quasi-fractal coplanar wave guide antenna of the present invention in the cassette coordinate including an x-axis, a y-axis and a z-axis. FIG. 8 is a reflection coefficient of frequency response schematic diagram of the quasi-fractal coplanar wave guide antenna of the present invention obtained by the simulation software.

Figure 6A:
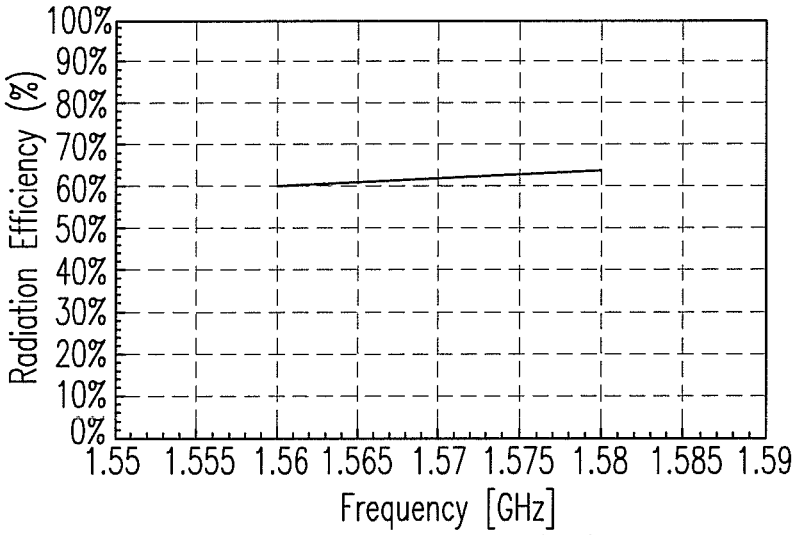
FIG. 6(*a*) is a radiation efficiency diagram illustrating the frequency band in a range of 1.56-1.58 GHz for the quasi-fractal coplanar wave guide antenna according to the present invention.
Figure 6B:
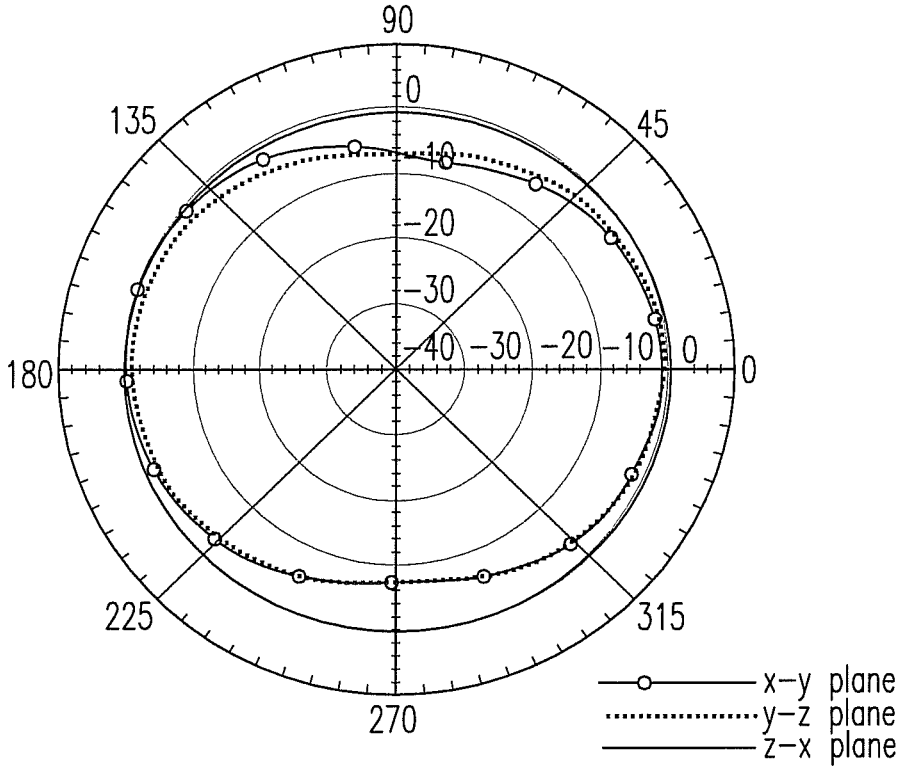

Based on the part of the loop antenna of the loop radiating portion 111*b*, the radiating portion 111*b* is configured at a periphery of the quasi-fractal radiating portion 111*a*, via the extension path at the external trace of the quasi-fractal radiating portion 111*a*, and finally electrically connected with the ground mental strip 221 of the printed circuit board of the lower coplanar wave guide structure 200 by the ground end 116 thereof. After testing, the antenna also has good matching characteristics $S_{11} \leftarrow 10$ dB in 1.575 GHz global positioning system (GPS) frequency band. Please refer to FIG. 6(*a*) which is a radiation efficiency diagram illustrating the frequency band in a range of 1.56-1.58 GHz for the quasi-fractal coplanar wave guide antenna according to the present invention obtained by the simulation software. FIG. 6(*b*) is a radiation pattern diagram illustrating the radiation pattern in 1.57 GHz for the quasi-fractal coplanar wave guide antenna according to the present invention obtained by the simulation software. The definition for the x-y plane, y-z plane and z-x plane in FIG. 6(*b*) is referred to FIG. 7, which is a relative position schematic diagram illustrating the quasi-fractal coplanar wave guide antenna in the cassette coordinate including an x-axis, a y-axis and a z-axis according to the present invention. FIG. 8 is a reflection coefficient of frequency response schematic diagram illustrating the quasi-fractal coplanar wave guide antenna according to the present invention obtained by the simulation software.

The dual frequency bands of the aforementioned quasi-fractal coplanar wave guide antenna have excellent performance that is more than 60% of radiation efficiency as compared with that in the low frequency portion and more than 90% of radiation efficiency as compared with that in the high frequency portion.

In view of the miniaturization of the antenna in the industry and the needs of the integration of the mobile communication device and the surface acoustic wave component, the present invention provides a quasi-fractal coplanar wave guide antenna which can render the size of the antenna in the mobile communication device being reduced in 5×5 $mm^2$ ($0.025\lambda_0 \times 0.025\lambda_0$), has a great advantage of easy to be integrated with the surface acoustic wave component without occupying extra space and has excellent effect on reducing the size.

There are further embodiments provided as follows.

Embodiment 1

In an antenna, including: a piezoelectric substrate and a radiating portion configured on the piezoelectric-substrate. The radiating portion includes a first radiating portion including a ground end and a signal feed end and a second radiating portion electrically connected with the first radiating portion and having a self-similar conformation.

Embodiment 2

In the antenna according to the above-mentioned embodiment 1, further including a dielectric substrate and a coplanar wave guide metal strip configured on the dielectric substrate.

Embodiment 3

In the antenna according to the above-mentioned embodiment 2, the coplanar wave guide metal strip includes: a ground metal strip electrically connected with the ground end and a coupling feed metal strip having a signal transmission end and a coupling feed end. The coupling feed end is electrically connected with the signal feed end.

Embodiment 4

In the antenna according to the above-mentioned embodiment 3, further including a bifurcation point connected to the first radiating portion and the second radiating portion. There is a specific distance between the bifurcation point and the coupling feed end.

Embodiment 5

In the antenna according to the above-mentioned embodiment 4, the specific distance is at least 1/80 wavelength of the lowest resonant frequency of the antenna in a free space. The bifurcation point is configured on a site of the specific distance from the coupling feed end.

Embodiment 6

In the antenna according to the above-mentioned embodiment 1, the second radiating portion has a sub-structure and a similar structure that is formed by an nth-order self-similar iteration process including a trimming step, a scaling step and a combining step based on the sub-structure. N is an integer greater than zero.

Embodiment 7

In the antenna according to the above-mentioned embodiment 6, the similar structure is formed as a structure of a quasi-Sierpinski Gasket fractal conformation.

Embodiment 8

In the antenna according to the above-mentioned embodiment 6, the sub-structure is one of a triangle and a quadrangle after trimmed. The quadrangle is one selected from a group consisting of a trapezoid, a rectangle and a square.

Embodiment 9

In the antenna according to the above-mentioned embodiment 1, the dielectric substrate is a printed circuit board substrate.

Embodiment 10

In the antenna according to the above-mentioned embodiment 1, the first radiating portion is surroundingly configured at a periphery of the second radiating portion.

Embodiment 11

In the antenna according to the above-mentioned embodiment 1, the first radiating portion has a hollow-out area. The pattern of the hollow-out area is corresponding to the whole pattern of the second radiating portion.

Embodiment 12

In the antenna according to the above-mentioned embodiment 1, the first radiating portion and the second radiating portion are conducting metal strips configured on the piezoelectric-substrate.

Embodiment 13

In the antenna according to the above-mentioned embodiment 1, the first radiating portion is a loop radiating portion. The second radiating portion is a quasi-fractal radiating portion.

Embodiment 14

In an antenna, including: a dielectric substrate layer and a quasi-fractal radiating layer configured on the dielectric substrate layer.

Embodiment 15

In the antenna according to the above-mentioned embodiment 14, the dielectric substrate layer is a piezoelectric material substrate layer.

Embodiment 16

In the antenna according to the above-mentioned embodiment 14, the quasi-fractal radiating layer has a quadrangle sub-structure and a similar structure that is formed by an nth-order self-similar iteration process including a trimming step, a scaling step and a combining step based on the quadrangle sub-structure. N is an integer greater than zero.

Embodiment 17

In the antenna according to the above-mentioned embodiment 14, the quadrangle is one selected from a group consisting of a trapezoid, a rectangle and a square.

Embodiment 18

In an antenna, including: a coplanar wave guide layer and a quasi-fractal antenna layer configured on the coplanar wave guide layer and having a self-similar conformation.

Embodiment 19

In the antenna according to the above-mentioned embodiment 18, the coplanar wave guide layer and the quasi-fractal antenna layer are connected by one of a flip chip process and a non-conductive adhesive method.

Embodiment 20

In the antenna according to the above-mentioned embodiment 18, the coplanar wave guide layer and the quasi-fractal antenna layer perform a coupling feed by a coplanar wave guide form.

While the invention has been described in terms of what is presently considered to be the most practical and preferred embodiments, it is to be understood that the invention needs not be limited to the disclosed embodiments. Therefore, it is intended to cover various modifications and similar configuration included within the spirit and scope of the appended claims, which are to be accorded with the broadest interpretation so as to encompass all such modifications and similar structures.

What is claimed is:

1. An antenna, consisting essentially of:

a rectangular piezoelectric substrate having a periphery, a central portion, a first side, a second side, a third side and a fourth side, wherein the first side and the third side are in parallel, and the second side and the fourth side are in parallel;

a copper radiating portion configured on the rectangular piezoelectric substrate, including:

a first radiating portion including a ground end, an L-shaped copper having a first end, a trapezoid shaped copper having an upper relatively long edge and a lower edge, a relatively long rectangular stripe, and a signal feed end, wherein the first radiating portion is a loop radiating portion extended along the periphery and having an equilateral triangular hollowed-out area with a left top end point, and a right end point located on the central portion of the rectangular piezoelectric substrate, the L-shaped copper is extended along the first side and the fourth side, the upper relatively lone edge is extended along the second side, the relatively long rectangular strip is extended along the third side, and the trapezoid shaped copper is connected to the relatively long rectangular stripe at the left top end point and is connected to the first end at the lower edge; and a second radiating portion located in the equilateral triangular hollowed-out area electrically connected with the first radiating portion and having a self-similar conformation, wherein the second radiating portion has a sub-structure being one selected from a group consisting of a triangle, a quadrangular structure and a quadrangular trapezoid structure and a similar structure that is formed by an nth-order self-similar iteration process including a trimming step, a scaling step and a combining step based on the sub-structure, where n is an integer greater than zero, the first radiating portion is surroundingly configured at a periphery of the second radiating portion, and a pattern of the hollowed-out area corresponds to an entire pattern of the second radiating portion, and the size of the triangular hollowed-out area accommodates another sub-structure;

a bifurcation point corresponding to the right end point and connected to the first radiating portion and the second radiating portion, wherein the L-shaped copper has a second end, the bifurcation point is located near the junction of the first end of the L-shaped copper and the lower edge of the trapezoid shaped copper, the second end of the L-shaped copper is electrically connected to the signal feed end at the fourth side, and the relatively long rectangular stripe has third end; and a ground metal strip located at the third side and electrically connected with the third end and the ground end.

2. The antenna according to claim 1, further consisting essentially of:

a dielectric substrate; and a coplanar wave guide metal strip configured on the dielectric substrate.

3. The antenna according to claim 2, wherein the coplanar wave guide metal strip includes:

a coupling feed metal strip having a signal transmission end and a coupling feed end, wherein the coupling feed end is electrically connected with the signal feed end.

4. The antenna according to claim 3, wherein there is a specific distance between the bifurcation point and the coupling feed end.

5. The antenna according to claim 4, wherein the specific distance is at least 1/80 wavelength of the lowest resonant frequency of the antenna in a free space.

6. The antenna according to claim 1, wherein the similar structure is firmed as a structure of a quasi-Sierpinski Gasket fractal conformation.

7. The antenna according to claim 1, wherein the sub-structure is one of a triangle and a quadrangle after trimmed, and the quadrangle is one selected from a group consisting of a trapezoid, a rectangle and a square.

8. The antenna according to claim 1, wherein the dielectric substrate is a printed circuit board substrate.

9. The antenna according to claim 1, wherein the first radiating portion and the second radiating portion are conducting metal strips configured on the rectangular piezoelectric-substrate.

10. The antenna according to claim 1, wherein the second radiating portion is a quasi-fractal radiating portion.

11. An antenna, consisting essentially of:

a square dielectric substrate layer having a central portion, a first side, a second side and a third side, wherein the first side is parallel to the third side, and the second side is perpendicular to the first side and the third side;

a loop radiating layer having a triangular hollowed-out area with a left top end point and a right end point and including a ground end, a signal feed end, an L-shaped copper having a length being a half length of one side of the square dielectric substrate layer, a shorter side and a longer side, a trapezoid shaped copper and a relatively long rectangular stripe having an end, wherein the longer side is extended along the first side, the shorter side is extended along the fourth side, the relatively long rectangular stripe is extended along the third side, the upper long edge of the trapezoid shaped copper has is an upper long edge extended along the second side, the trapezoid shaped copper is connected to the relatively long rectangular stripe at the left top end point and to the L-shaped copper at the right end point, the ground end is connected to the end in the third side, and the signal feed end is connected to the shorter side; and a quasi-fractal radiating layer configured between the relatively long rectangular stripe and the trapezoid shaped copper, and on the central portion of the square dielectric substrate layer, wherein the quasi-fractal radiating layer is connected to the trapezoid shaped copper at a bifurcation point being the right end point and has a sub-structure being one selected from a group consisting of a triangle, a quadrangular structure and a quadrangular trapezoid structure and a similar structure that is formed by an nth-order self-similar iteration process including a trimming step, a scaling step and a combining step based on the sub-structure, where n is an integer greater than zero, the loop radiating layer is surroundingly configured at a periphery of the quasi-fractal radiating layer, and a pattern of the hollowed-out area corresponds to an entire pattern of the quasi-fractal radiating layer, and the size of the triangular hollowed-out area accommodates another sub-structure.

12. The antenna according to claim 11, wherein the dielectric substrate layer is a piezoelectric material substrate layer.

13. The antenna according to claim 11, wherein the sub-structure is a quadrangle sub-structure.

14. The antenna according to claim 11, wherein the quadrangle is one selected from a group consisting of a trapezoid, a rectangle and a square.

15. An antenna, consisting essentially of:

a coplanar wave guide layer having a square piezoelectric substrate having a first right-hand side, a bottom side, an upper side and first left-hand side;

a loop radiating layer having a triangular hollowed-out area with a left top end point, a right end point being a bifurcation point, L-shaped copper having a length being a half length of one side of the square piezoelectric substrate, a shorter side and a longer side, a trapezoid shaped copper having a second left-hand side, and a relatively long rectangular stripe having a second right-hand side and an end, wherein the longer side is on the right-hand side, the shorter side is on the bottom side, the relatively long rectangular strip is on the left-hand side, the trapezoid shaped copper is on the upper portion of the square piezoelectric substrate, and the trapezoid shaped copper is connected to the relatively long rectangular stripe at the left top end point and to the L-shaped copper at an end of the longer side;

a quasi-fractal antenna layer configured between the second right-hand side and the second left-hand side on the coplanar wave guide layer and having a self-similar conformation, wherein the quasi-fractal antenna layer is connected to the trapezoid shaped copper at the bifurcation point, has a sub-structure being one selected from a group consisting of a triangle, a quadrangular structure and a quadrangular trapezoid structure and a similar structure that is formed by an nth-order self-similar iteration process including a trimming step, a scaling step and a combining step based on the sub-structure, where n is an integer greater than zero, the loop radiating layer is surroundingly configured at a periphery of the quasi-fractal antenna layer, and a pattern of the triangular hollowed-out area corresponds to an entire pattern of the quasi-fractal antenna layer and the size of the triangular hollowed-out area accommodates another sub-structure;

aground end connected to the end of the relatively long rectangular stripe; and a signal feed end connected to the shorter side.

16. The antenna according to claim 15, wherein the coplanar wave guide layer and the quasi-fractal antenna layer are connected by one of a flip chip process and a non-conductive adhesive method.

17. The antenna according to claim 15, wherein the coplanar wave guide layer and the quasi-fractal antenna layer perform a coupling feed by a coplanar wave guide form.

18. The antenna according to claim 1, wherein the antenna is a quasi-fractal coplanar wave guide antenna, and the size of the antenna is about $0.025\lambda_0 \times 0.025\lambda_0$, wherein $\lambda_0$ is a wavelength in the lowest resonant frequency range of 1.57-1.58 GHz.

* * * * *